US005101083A

United States Patent [19]

Tyler et al.

[11] Patent Number: 5,101,083

[45] Date of Patent: Mar. 31, 1992

[54] RAIN SWITCH

[75] Inventors: Stephen L. Tyler, Diamond Bar; John L. Staylor, Riverside, both of Calif.

[73] Assignee: The Toro Company, Minneapolis, Minn.

[21] Appl. No.: 568,952

[22] Filed: Aug. 17, 1990

[51] Int. Cl.[5] ..... H01H 35/00

[52] U.S. Cl. ..... 200/61.04; 200/61.06

[58] Field of Search ..... 200/61.04–61.07

[56] References Cited

U.S. PATENT DOCUMENTS

| | | | |
|---|---|---|---|
| 2,041,658 | 5/1936 | Hodge | 200/61.06 |
| 2,688,056 | 8/1954 | Kettering et al. | 200/61.06 |
| 2,760,023 | 8/1956 | Kettering et al. | 200/61.06 |
| 3,165,602 | 1/1965 | Maguire, Jr. | 200/61.06 |
| 3,204,872 | 9/1965 | Whear | 200/61.06 X |
| 3,441,693 | 4/1969 | Bunn | 200/61.04 |
| 3,512,712 | 5/1970 | Benesch | 200/61.06 X |
| 3,808,385 | 4/1974 | Klinefelter | 200/61.04 |

OTHER PUBLICATIONS

Mini Clik II Advertisement—Oct. 1987.

"What You Should Know About Rain Sensor Shutoffs" Brochure.

Mini Clik II "Saves You Money On A Rainy Day" Brochure.

Mini Clik II "The Rain Sensor For Dependable Sprinkler Control" Brochure.

Mini Clik II "Rain Sensor" Specification Sheet.

*Primary Examiner*—J. R. Scott

*Attorney, Agent, or Firm*—James W. Miller

[57] ABSTRACT

An improved rain switch includes a tubular L-shaped housing having an enclosed compartment in one arm in which an electrical switch is contained and an apertured compartment in the other arm in which a moisture absorptive assembly is contained. When mounted on a building with the apertured arm parallel to the ground, the electrical switch will be located to one side of the apertured arm and is not prone to coming into contact with any of the rain water passing through the device. Thus, a non-sealed electrical switch can be used. In addition, the housing is snap fit to the building and the electrical switch is releasably contained on a slide member received in the housing to ease switch replacement. A cover also hides a threaded adjusting cap to prevent unauthorized adjustment for how much water is required to be absorbed before the electrical switch is actuated.

24 Claims, 3 Drawing Sheets

RAIN SWITCH

TECHNICAL FIELD

The present invention relates to a rain switch which may be wired into the controller that controls the operation of an irrigation system for preventing the irrigation system from operating when it is raining.

BACKGROUND OF THE INVENTION

Irrigation systems typically comprise a plurality of separate stations each having one or more sprinklers supplied by a common valve. An irrigation controller causes the stations to run or operate in accordance with a schedule or program stored in the controller. However, it is usually not necessary for irrigation to take place when it is raining. Various rain switches are known which override the controller's commands and prevent any scheduled watering during rainfall. This conserves water.

U.S. Pat. No. 3,808,385 to Klinefelter discloses a prior art rain switch in which an electrical switch is wired into the irrigation control system to prevent irrigation whenever the switch opens. The switch is actuated by a plurality of hygroscopic discs which expand when wet to push on a plunger that is in contact with the electrical switch. The plunger will open and close the electrical switch.

Prior known switches are not very versatile in terms of how they can be mounted on buildings or walls. They typically also include a large number of components that can be difficult to disassemble for the purpose of repair or replacement. In addition, the electrical switch is often supported in a manner in which it is exposed to the rain water. This requires a moisture impervious sealed switch to be used, further increasing the cost and complexity of the device.

SUMMARY OF THE INVENTION

Accordingly, one aspect of this invention is to provide an improved rain switch which is simple, is easy to assemble or disassemble, and which uses a non-sealed electrical switch.

These and other aspects of the invention are provided in a rain switch which comprises a housing which may be secured to a support. An electrical switch having an actuating button is contained within the housing. A moisture absorptive assembly is also contained within the housing. The moisture absorptive assembly expands upon absorbing rain water to push against the button and actuate the switch thereby preventing the irrigation system from operating when it is raining. The housing includes a slotted or apertured portion adjacent the moisture absorptive assembly for allowing rain water to reach and wet the assembly. The switch is located in a substantially enclosed portion of the housing separated from the moisture absorptive assembly by an interior wall of the housing which is closed except for an opening that allows a portion of the moisture assembly to pass therethrough and actuate the switch. The opening in the interior wall is located to one side of the switch when the slotted or apertured position is located parallel to the ground such that rain water passing into the slotted or apertured portion and wetting the moisture absorptive assembly will not flow by gravity into the closed portion of the housing in which the electrical switch is contained.

Desirably, the housing is L-shaped with the electrical switch being in a first arm of the housing and the moisture absorptive assembly being in a second arm of the housing which is substantially at right angles to the first arm.

In addition, the rain switch of this invention includes a rotatable threaded cap for adjusting the amount of rainfall required to actuate the device, which cap is normally covered by an indicia containing cover.

Moreover, the electrical switch is mounted on a slide member that may be slid into the housing, and the housing includes a snap fit attachment to a mounting bracket, for ease of use and assembly.

BRIEF DESCRIPTION OF THE DRAWINGS

The present invention will be described in more detail in the following Detailed Description, taken in conjunction with the following drawings, in which like reference numerals refer to like elements throughout.

DETAILED DESCRIPTION

Figure 1:
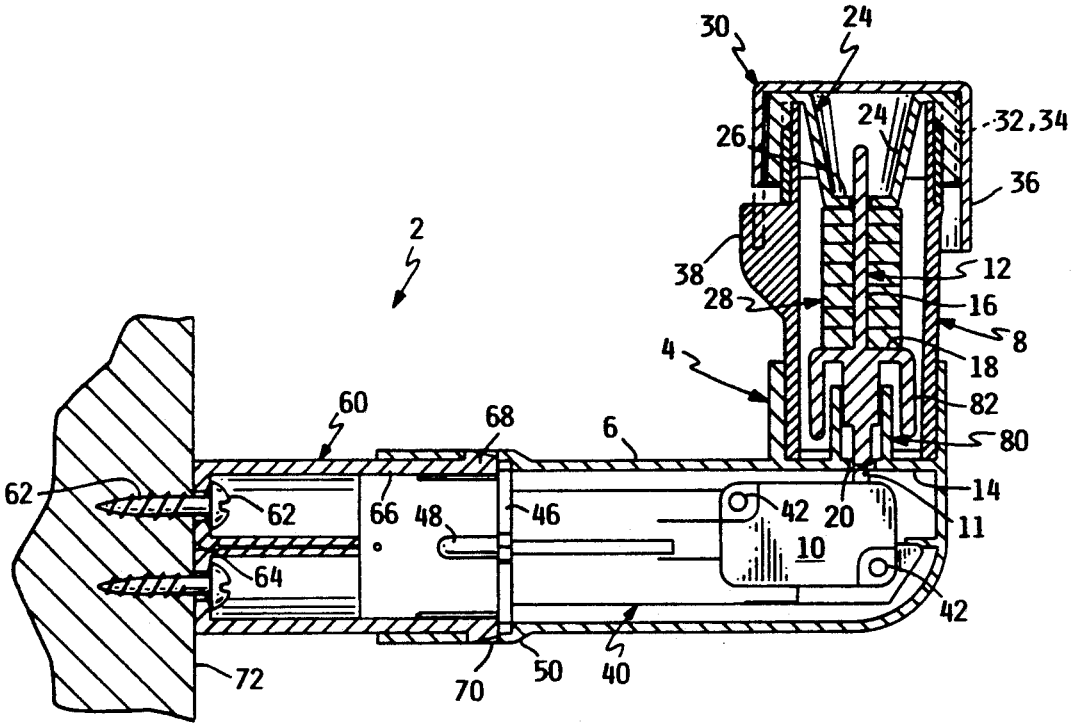
FIG. 1 is a top cross-sectional view of a rain switch according to this invention, particularly illustrating the rain switch attached to a support surface.

The present invention relates to a rain switch generally indicated as 2 in the drawings. Rain switch 2 includes an L-shaped tubular housing 4 having first and second portions 6 and 8 arranged substantially at right angles to one another. First portion 6 is substantially enclosed while second portion 8 is slotted or apertured over its surface. First portion 6 defines a first compartment which houses a conventional electrical micro-switch 10. Second portion 8 defines a second compartment which houses a moisture absorptive assembly indicated generally as 12. An interior wall 14 in housing 4 separates and divides the first and second compartments from each other.

Moisture absorptive assembly 12 includes a slidable plunger 16 having an enlarged plunger head 18. One end of plunger 16 extends through a small opening 20 in interior wall 14 to engage a spring loaded actuating button 11 on micro-switch 10. The other end of plunger 16 extends through a rotatable cap 24 which is threaded onto the outer end of housing portion 8. Cap 24 can be rotated on housing 4 to vary the distance between plunger head 18 and an opposed abutment 26 on cap 24.

A moisture absorptive medium is located on plunger 16 between plunger head 18 and abutment 26. Preferably, this medium comprises a plurality of hygroscopic discs 28 made of any suitable material which will expand or swell when exposed to water, e.g. paper, cardboard, wood and the like. Discs 28 are located within the apertured portion 8 of housing 4 to be exposed to rain water or the like. When discs 28 become wet and expand, they push against plunger head 18 to slide plunger 16 relatively to housing 4 to depress switch button 11. This actuates micro-switch 10 and prevents the irrigation system to which rain switch is connected from operating. Micro-switch 10 is connected to an irrigation controller in any known manner to prevent the irrigation system from operating when it is raining.

The sensitivity of switch 2 is adjusted by rotating cap 24 on housing 4 to move abutment 26 towards or away from plunger head 18. The greater the distance between the two, the more water is required to actuate micro-switch 10. Abutment 26 is conveniently formed by a lower surface of cap 24 through which the top of plunger 16 extends. However, abutment 26 could be provided in other ways.

A separate cylindrical cover 30 is press fit onto cap 24 and is non-rotatably secured thereto. The exterior diameter of cap 24 is provided with a plurality of longitudinal splines 32 and the internal diameter of cover 30 is provided with one or more ribs 34 for engaging these splines. Thus, when cover 30 is slid onto cap 24, cover 30 can be gripped and turned to rotate cap 24 through the splined connection between the two.

Cover 30 includes a downwardly depending arcuate tab 36 that engages an index flange 38 on the outside of housing 4. This allows cover 30, and hence cap 24, to be infinitely rotated from a first position in which tab 36 engages one side of flange 38 around to a second position in which the tab engages the other side of flange 38, i.e. approximately 330°-360° depending on the thicknesses of tab 36. Tab 36 is show in solid lines in FIG. 1 spaced approximately 180° away from flange 38 and in phantom lines in FIG. 1 having been rotated to engage the backside of flange 38. The top surface of cover 30 is provided with various markers or indicia (not shown) that can be read by virtue of their alignment or non-alignment with flange 38 to indicate the amount of relative adjustment of cap 24. These markers are preferably the approximate amounts of rainfall that would be required to cause the actuation of microswitch 10, e.g., ¼", ½" or 1" of rainfall. Thus, the user can get some idea of what the current setting is and in what direction cap 24 should be rotated to adjust to a new setting simply by glancing at cover 30.

The rainfall indicia or markers could be placed directly on cap 24 or cover 30 dispensed with if desired. However, cover 30 performs an important vandal resistant feature by enclosing and hiding cap 24. In addition, the engagement of tab 36 with flange 38 limits the rotation of cover 30, and hence cap 24, to something slightly less than 360° so that cap 24 cannot be screwed all the way off. While cover 30 can be pulled off cap 24 by disengaging the ribs from the splines, which allows complete disassembly of cap 24 to provide access to the moisture absorptive assembly 12 for repair or replacement, it is not apparent that cover 30 can be removed this way unless one is familiar with the product. Thus, unauthorized tampering with rain switch 2 is discouraged.

For ease of assembly and repair, micro-switch 10 is slidably contained inside housing 4 on an elongated slide member 40. Slide member 40 has two upwardly extending posts 42 on one end thereof. The case of micro-switch 10 is provided with two holes to allow micro-switch 10 to simply be dropped down onto posts 42. The other end of slide member 40 has a circular flange 46 which includes an outwardly extending handle 48.

The user or assembler first places micro-switch 10 onto the end of slide member 40. Slide member 40 can then be inserted into the open end of first portion 6 and slid inwardly using handle 48. Various guide surfaces (not shown) may be formed on the interior walls of housing portion 6 for guiding member 40 into place. When slide member 40 is fully seated, micro-switch 10 will be positioned as shown in FIG. 1 with switch button 11 adjacent the interior wall opening 20. Circular flange 46 of slide member 40 will abut against an annular shoulder 50 in housing portion 6.

Novel attachment means are used for supporting rain switch 2 on a suitable building structure. The attachment means includes a cylindrical mounting bracket 60 which may be telescopically inserted into the open end of housing portion 6. Bracket 60 is secured to a support surface using a plurality of mounting screws 62 extending through an end wall 64 of bracket 60. Bracket 60 includes a plurality of spring biased arms 66 having tangs 68 designed to snap fit into openings 70 at the end of housing portion 6.

Thus, to install or mount rain switch 2, mounting bracket 60 is first secured to the support surface by screws 62. Housing 4 is simply snap fit onto bracket 60 by pushing housing portion 6 onto bracket 60. Bracket 60 includes an opening in its cylindrical side walls for allowing electrical wires to be passed into the interior of housing 4 for connection to the leads of micro-switch 10. Circular flange 46 of slide member 40 is also provided with suitable openings for allowing these connection wires to pass therethrough.

In addition to the manner of mounting bracket 60 just described, bracket 60 is also sized to have an outer diameter that may be tightly press fit into a piece of hollow, irrigation tubing, e.g. three quarter inch PVC pipe. This increases the versatility of how rain switch 2 can be mounted. For example, a piece of tubing can be put in place on the building, or even left free-standing in the ground, and the bracket 60 can then be pushed into the tubing. Switch 2 can then be pushed onto bracket 60.

Figure 2:
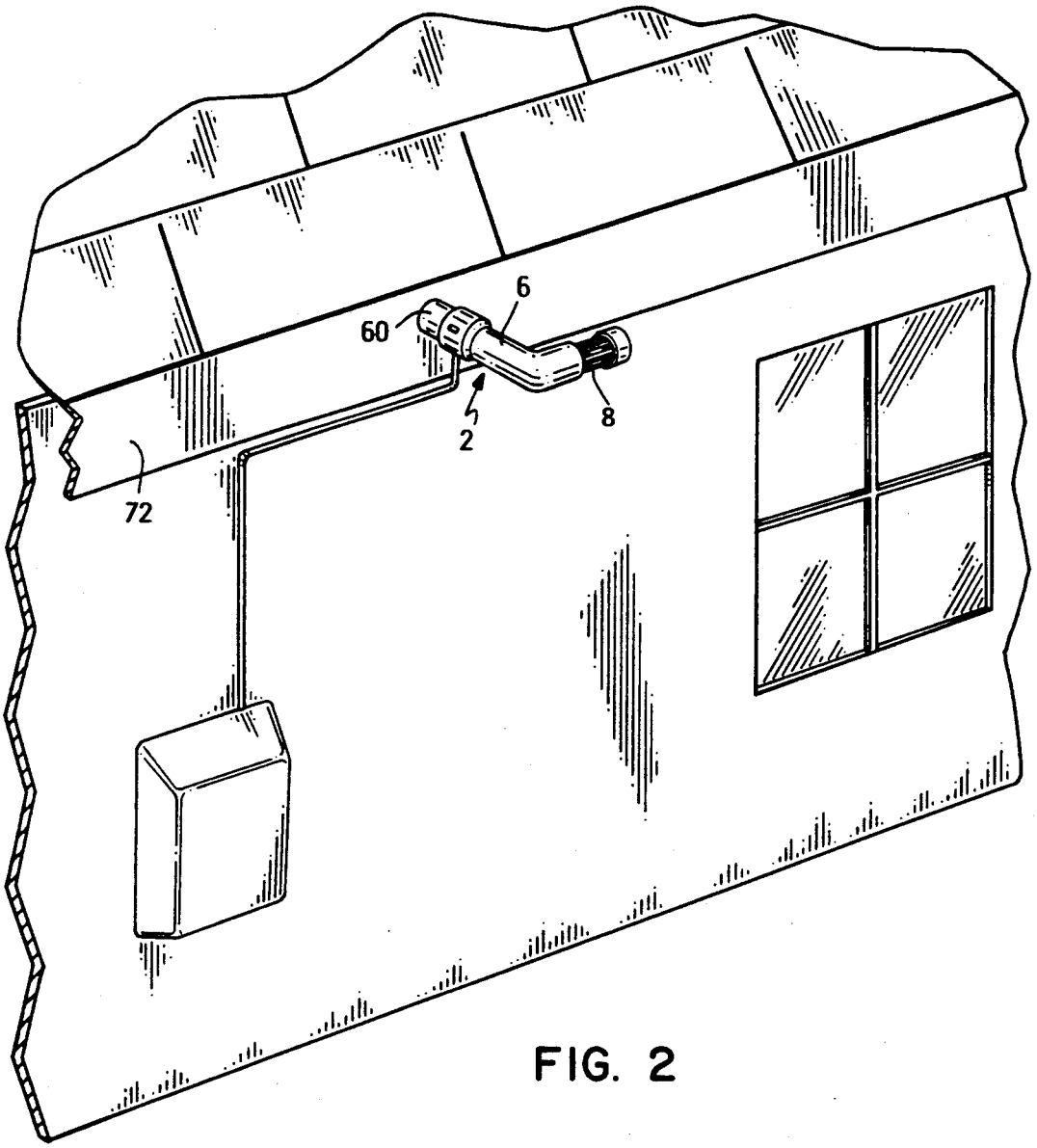
FIG. 2 is a perspective view illustrating a first way in which the rain switch of FIG. 1 would typically be mounted on a building.

Rain switch 2 of this invention is very versatile in how it can be mounted on a building. For example, it can be mounted as shown in FIG. 2 to a vertical surface such as a building eave 72. When so mounted, the opening 20 into the enclosed switch containing compartment in housing portion 6 will be at or above the level of the apertured compartment in housing portion 8 and not below that level. In other words, enclosed portion 6 does not directly underlie slotted portion 8 but is to one side thereof. Thus, rain water passing down into slotted portion 8 will normally drain down through that portion without attempting to pass through opening 20 into contact with micro-switch 10..

This water transmission is made more difficult by imposing a tortuous water flow path between housing portions 6 and 8. This path is formed by an upstanding cylindrical shell 80 on interior wall 14 which surrounds the lower portion of plunger 16. Plunger head 18 includes a cylindrical sleeve 82 that extends downwardly therefrom to substantially overlap shell 80 and leave only a small radial gap therebetween. Any water attempting to pass into contact with micro-switch 10 first has to flow down around sleeve 82, through the radial gap and back along the length of shell 80 before it can pass through opening 20. This is very difficult for water to do.

As a result of this construction, Applicants have found that a micro-switch 10 can be used which is not specially sealed against water. This substantially reduces the cost of rain switch 2. A specially sealed, water impervious micro-switch 10 costs many times more than a non-sealed micro-switch. Thus, the cost of rain switch 2 is reduced while still functioning properly in normal use conditions over the life of the product. Micro-switch 10 will simply not be shorted out by water as water will not make its way into contact with the switch.

Figure 3:
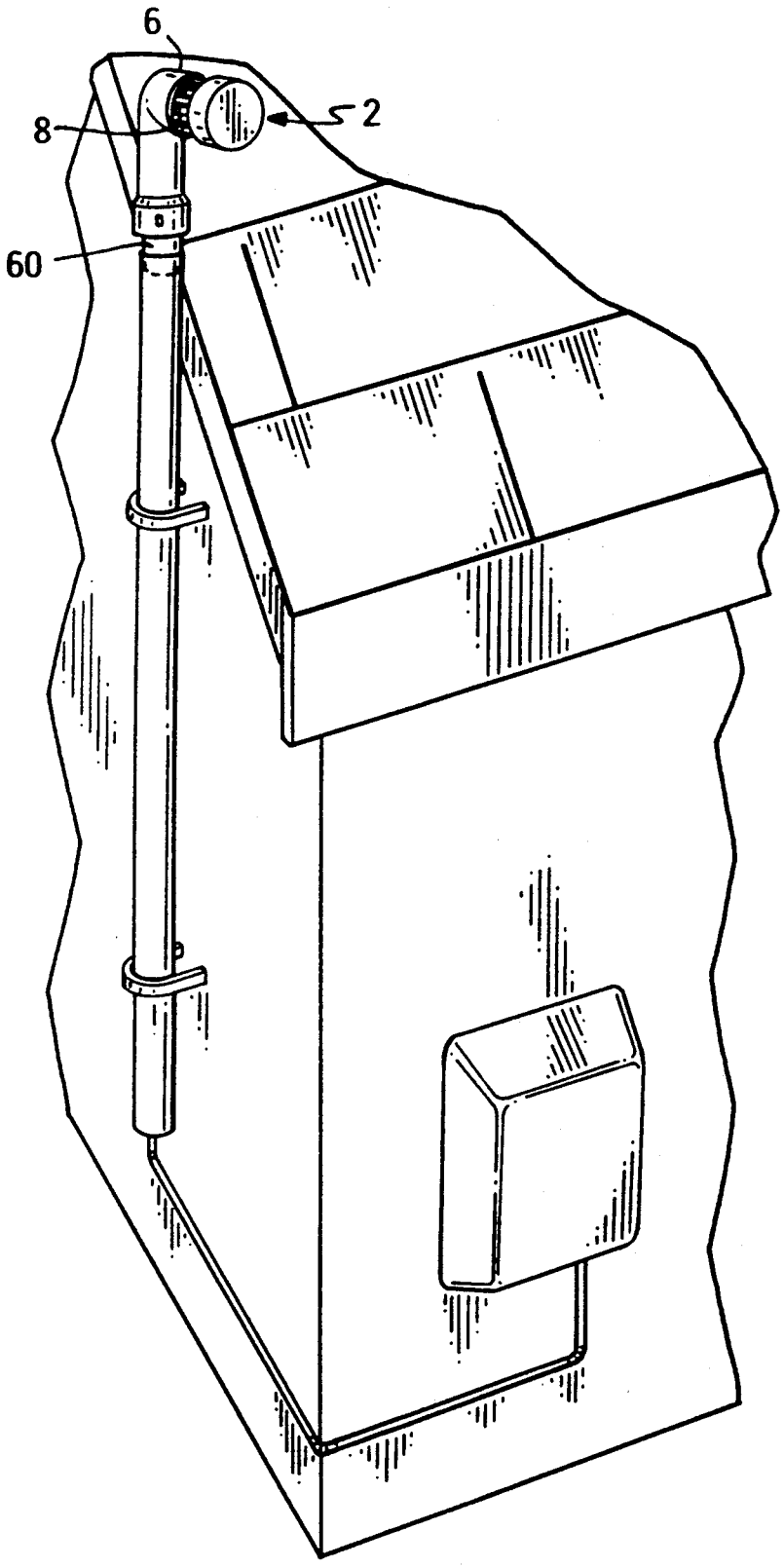
FIG. 3 is a perspective view illustrating an alternative way of mounting the rain switch shown in FIG. 1.

Another alternative mounting for rain switch 2 is shown in FIG. 3. In this mounting, rain switch 2 is attached to a horizontal support surface. However, because of the L-shaped construction of rain switch 2, the slotted portion 8 is still not placed over the switch containing portion 6, but is to one side thereof. The opening 20 in the interior wall 14 is still at or above the level of the switch button, and the same advantages of resistance to moisture degradation of micro-switch 10 are present.

Rain switch 2 of this invention is easy to install and service. If there is a problem with micro-switch 10, housing 4 can simply be pulled off mounting bracket 60 to expose the interior switch compartment. Slide member 40 can be pulled out at that point and the defective micro-switch 10 lifted off slide member 40. A new micro-switch 10 can be dropped on, slide member 40 reinserted and housing 4 reattached. This can be done without using any tools. In addition, moisture absorptive assembly 12 is easily replaceable through the other end of housing 4 by removing first cover 30 and then by screwing cap 24 off. This can also be done without tools with housing 4 left in place on bracket 60 or removed from bracket 60.

Various modifications of this invention will be apparent to those skilled in the art. Thus, the scope of this invention is to be limited only by the appended claims.

We claim:

1. An improved rain switch for use in an irrigation system, which comprises:

(a) an elongated housing having a connecting portion which is suited to be secured to a support and a slotted or apertured portion adjacent to the connecting portion;

(b) an electrical switch contained within the connecting portion of the housing;

(c) a moisture absorptive assembly contained within the slotted or apertured portion of the housing, wherein the moisture absorptive assembly expands upon absorbing rain water to actuate the switch thereby preventing the irrigation system from operating when it is raining, wherein the moisture absorptive assembly is located within the slotted or apertured portion of the housing in a position for allowing rain water to reach and wet the assembly; and (d) wherein the housing is substantially L-shaped with the connecting portion substantially at right angles relative to the slotted or apertured portion, whereby the slotted or apertured portion can be spaced to one side of the connecting portion so as not to overlie the connecting portion when the connecting portion is secured to the support.

2. An improved rain switch as recited in claim 1, wherein the connecting portion and the slotted or apertured portion of the housing are each tubular in shape with the tubular housing portions being connected together substantially at right angles to form the L-shaped housing.

3. An improved rain switch as recited in claim 1, wherein the electrical switch is fixedly held within the connecting portion of the housing in a position suited to be contacted and actuated by the moisture absorptive assembly during operation of the switch.

4. An improved rain switch as recited in claim 3, wherein the moisture absorptive assembly includes a movable plunger, wherein the connecting portion of the housing is substantially enclosed and is separated from the slotted or apertured portion of the housing by an interior wall of the housing which is closed except for an opening that allows one end of the plunger to pass therethrough and actuate the switch.

5. An improved rain switch as recited in claim 1, further including snap fit attachment means for securing the connecting portion to the support.

6. An improved rain switch as recited in claim 5, wherein the attachment means comprises a mounting bracket into which one end of the connecting portion is telescopically received, the one end of the housing and the mounting bracket having means for connecting the two together with a snap fit.

7. An improved rain switch as recited in claim 6, further including a plurality of resilient tabs formed on the mounting bracket or the one end of the housing which are resiliently received in apertures in the other member, wherein the resilient engagement between the tabs and the apertures is sufficiently weak to allow the tabs to be cammed out of engagement with the apertures when the housing is pulled outwardly relative to the mounting bracket but is sufficiently strong to allow the housing to remain engaged with the bracket when the pulling force is absent.

8. An improved rain switch as recited in claim 6, wherein the mounting bracket includes a substantially planar mounting surface which is suited to be abutted against a flat surface on the support such that the mounting bracket may be secured to the support by one or more fasteners which pass through the mounting surface of the mounting bracket and are received in the support.

9. An improved rain switch as recited in claim 5, wherein the attachment means comprises a cylindrical mounting bracket sized to be fitted into the cylindrical bore of a standard size of irrigation tubing, such that the bracket may also be secured to a non-planar support member such as irrigation tubing.

10. An improved rain switch for use in an irrigation system, which comprises:

(a) a housing which is suited to be secured to a support;

(b) an electrical switch having an actuating button contained within the housing;

(c) a moisture absorptive assembly contained within the housing, wherein the moisture absorptive assembly expands upon absorbing rain water to push against the button and actuate the switch thereby preventing the irrigation system from operating when it is raining, wherein the housing includes a slotted or apertured portion adjacent the moisture absorptive assembly for allowing rain water to reach and wet the assembly; and (d) wherein the switch is located in a substantially enclosed portion of the housing separated from the moisture absorptive assembly by an interior wall of the housing which is closed except for an opening that allows a portion of the moisture assembly to pass therethrough and actuate the switch, and wherein the opening in the interior wall is located to one side of the switch when the slotted or apertured position is located parallel to the ground such that rain water passing into the slotted or apertured portion and wetting the moisture absorptive assembly will not flow by gravity into the closed portion of the housing in which the electrical switch is contained.

11. An improved rain switch as recited in claim 10, wherein the electrical switch has an external housing which is not specially sealed against moisture.

12. An improved rain switch as recited in claim 10, wherein the moisture absorptive assembly includes an elongated plunger contained in the slotted or apertured portion of the housing which plunger passes through the opening in the interior wall into engagement with the actuating button on the switch, the moisture absorptive assembly having moisture absorptive means carried on the plunger for longitudinally moving the plunger relative to the interior wall such that the plunger depresses the switch actuation button when the moisture absorptive means has absorbed sufficient rain water, and further including barrier means extending between the plunger and the opening for impeding transmission of water into the switch containing portion of the housing.

13. An improved rain switch as recited in claim 10, where the barrier means comprises a non-linear water flow path between the moisture absorptive means on the plunger and the opening in the interior housing wall 14. An improved rain switch as recited in claim 13, wherein the interior wall has a cylindrical shell surrounding the opening and extending outwardly from the wall into the slotted or apertured housing portion, wherein the plunger includes a cylindrical sleeve which overlaps the cylindrical shell at all times over the range of motion of the plunger and is separated from the shell by an annular gap, whereby any water reaching the moisture absorptive means on the plunger has to pass around the sleeve, be forced back through the annular gap until reaching the end of the shell, and then flow back past the shell in order to reach the opening in the interior wall, the overlapping sleeve and shell thereby defining the non-linear flow path.

15. An improved rain switch as recited in claim 14, wherein the annular gap has a very small radial depth in relation to the amount of overlap between the sleeve and the shell.

16. An improved rain switch for use in an irrigation system, which comprises:

(a) a generally cylindrical housing;

(b) an electrical switch located within the housing;

(c) a moisture absorptive assembly which expands upon absorbing rain water to actuate the switch thereby preventing the irrigation system from operating when it is raining, wherein the moisture absorptive assembly includes an elongated plunger on which moisture absorptive means are carried, the moisture absorptive means located between an enlarged head on the plunger and an abutment and normally having a clearance with respect to the abutment, the moisture absorptive means swelling when contacted by rain water until such means firmly engages the abutment and then pushes against the head on the plunger to slide the plunger in the housing and actuate the switch; and (d) an adjustable cap threaded onto one end of the housing to be rotatable on the housing and to close the one end of the housing, wherein the cap has a substantially planar surface which is located inside the housing and is spaced away from the enlarged head of the plunger when the cap is in place on the housing such that the planar surface of the cap inside the housing forms the abutment, whereby the cap may be rotated on the housing by virtue of its threaded connection relative to the housing to vary the distance between the planar surface of the cap and the enlarged head of the plunger to adjust the amount of rain water needed to get switch actuation.

17. An improved rain switch as recited in claim 16, further including a cover releasably secured to and overlying the cap for rotating the cap when the cover is rotated.

18. An improved rain switch as recited in claim 17, wherein the cover has a tab for engaging an outwardly extending index flange on the housing to limit rotation of the cover from engagement of the tab with one side of the flange to engagement of the tab with the other side of the flange.

19. An improved rain switch as recited in claim 18, wherein the cover includes indicia means that may be read against the index flange to indicate the amount of rainfall required to obtain switch actuation.

20. An improved rain switch as recited in claim 18, wherein the cover has means for allowing the cover to telescopically inserted over the cap and to rotatably grip the cap when so inserted, and the cover when inserted over the cap serving to hide the cap.

21. An improved rain switch as recited in claim 20, wherein a plurality of longitudinally extending splines are formed on an exterior of the cap for mating engagement with at lest one rib on an interior of the cover, the splines and ribs coupling the cap and cover together for simultaneous rotation but allowing the cover to be removed from the cap by pulling the cover off the cap.

22. An improved rain switch for use in an irrigation system, which comprises:

(a) a tubular housing separated into first and second compartments by an interior wall, the first compartment being substantially enclosed except for an open end thereof and the second compartment having a slotted or apertured surface, the interior wall having an opening communicating between the first and second compartments;

(b) an electrical switch located in the first compartment with an actuating button thereof being located adjacent the opening in the interior wall;

(c) a moisture absorptive assembly located in the second compartment and including an elongated plunger which passes through the opening to contact and actuate the switch when the moisture absorptive means absorbs rain water passing into the second compartment through the slots or apertures;

(d) wherein the switch is releasably mounted on a slide member that may be inserted into the first compartment of the housing by passing it inwardly through the normally open end thereof; and (e) attachment means for securing the housing to a support, the attachment means normally closing the open first end of the first compartment so that the first compartment is substantially enclosed when the housing is secured to the attachment means.

23. An improved rain switch as recited in claim 22, wherein the attachment means comprises a mounting bracket into which the open first end of the first compartment of the housing is telescopically received until the open first end of the first compartment is enclosed within the mounting bracket, and further including snap fit means for securing the mounting bracket to the housing.

24. An improved rain switch as recited in claim 22, wherein the housing is L-shaped with the first and second compartments being located substantially at right angles relative to one another.

* * * * *

UNITED STATES PATENT AND TRADEMARK OFFICE

CERTIFICATE OF CORRECTION

PATENT NO. : 5,101,083

DATED : March 31, 1992

INVENTOR(S) : Stephen L. Tyler et al.

It is certified that error appears in the above-identified patent and that said Letters Patent is hereby corrected as shown below:

Column 3, line 22, "show" should read --shown--.

Column 3, line 37, insert --or-- before "dispensed".

Column 6,
In claim 10, "position" should read --portion-- at Column 6, line 65.

Column 7,
In claim 13, "claim 10" should read --claim 12-- at Column 7, line 19.

Column 8
In claim 20, insert --be-- before "telescopically" at Column 8, line 18.

In claim 21, "lest" should read --least-- at Column 8, line 24.

Signed and Sealed this

Thirteenth Day of July, 1993

*Attest:*

Michael K. Kirk

MICHAEL K. KIRK

*Attesting Officer*

*Acting Commissioner of Patents and Trademarks*